US012227909B2

(12) United States Patent
Sun

(10) Patent No.: US 12,227,909 B2
(45) Date of Patent: Feb. 18, 2025

(54) WIND-RESISTANT SUSPENSION BRIDGE

(71) Applicant: Shanghai Yingfeng Technology Development Co., Ltd., Shanghai (CN)

(72) Inventor: Deming Sun, Sichuan (CN)

(73) Assignee: Shanghai Yingfeng Technology Development Co., Ltd., Shanghai (CN)

( * ) Notice: Subject to any disclaimer, the term of this patent is extended or adjusted under 35 U.S.C. 154(b) by 387 days.

(21) Appl. No.: 17/679,077

(22) Filed: Feb. 23, 2022

(65) Prior Publication Data

US 2022/0178092 A1 Jun. 9, 2022

Related U.S. Application Data

(63) Continuation of application No. PCT/CN2021/114587, filed on Aug. 25, 2021.

(30) Foreign Application Priority Data

Aug. 27, 2020 (CN) ..... 202010881881.8
Aug. 24, 2021 (CN) ..... 202110976112.0

(51) Int. Cl.
*E01D 11/02* (2006.01)
*E01D 19/14* (2006.01)
*E01D 19/16* (2006.01)

(52) U.S. Cl.
CPC ..... *E01D 11/02* (2013.01); *E01D 19/14* (2013.01); *E01D 19/16* (2013.01)

(58) Field of Classification Search
CPC ..... E01D 11/02; E01D 19/14; E01D 19/16
See application file for complete search history.

(56) References Cited

U.S. PATENT DOCUMENTS 297,479 A * 4/1884 Wegner ..... E01D 11/02 D8/382
1,454,772 A * 5/1923 Sullivan ..... E01D 11/02 14/18

(Continued)

FOREIGN PATENT DOCUMENTS

CN 101418542 A 4/2009
CN 101672002 A 3/2010

(Continued)

OTHER PUBLICATIONS

Chen, Jun, Design of Tongsheng Lake Suspension Bridge, Chinese & Overseas Architecture, 2007, pp. 35-37, vol. 5, China Academic Journal Electronic Publishing House.

(Continued)

*Primary Examiner* — Abigail A Risic

(57) ABSTRACT

A wind-resistant suspension bridge includes a bridge tower, a bridge body, a main rope, a suspension rope and a guardrail. The suspension bridge further includes a wind-resistant rope, one end of which is connected to the bridge tower and the other end of which is connected to the main rope. The wind-resistant rope, the main rope and the bridge tower form a substantially triangle. The contact point between the bridge tower and the main rope, the connection point between the wind-resistant rope and the main rope, and the connection point between the wind-resistant rope and the bridge tower form the three vertices of the substantially triangle.

8 Claims, 15 Drawing Sheets

(56) References Cited

U.S. PATENT DOCUMENTS

| | | | | | |
|---|---|---|---|---|---|
| 2,217,593 | A * | 10/1940 | London | E01D 11/00 14/18 |
| 2,433,878 | A * | 1/1948 | Wolfard | E01D 11/00 14/19 |
| 2,457,427 | A * | 12/1948 | Wolfard | E01D 11/00 14/18 |
| 4,982,538 | A * | 1/1991 | Horstketter | E04B 5/046 52/340 |
| 5,493,746 | A * | 2/1996 | Minakami | E01D 11/04 14/18 |
| 10,634,386 | B2 * | 4/2020 | Adel | F24S 23/745 |
| 2008/0313825 | A1 * | 12/2008 | Murakoshi | E01D 11/00 14/19 |
| 2022/0178092 | A1 * | 6/2022 | Sun | E01D 19/14 |

FOREIGN PATENT DOCUMENTS

| | | | |
|---|---|---|---|
| CN | 204875482 | U | 12/2015 |
| CN | 106400670 | A | 2/2017 |
| CN | 106958189 | A | 7/2017 |
| CN | 107386091 | A | 11/2017 |
| CN | 108978436 | A | 12/2018 |
| JP | H11323837 | A | 11/1999 |

OTHER PUBLICATIONS

Guo, Zengwei et al., Advances in Flutter Control Measures of Long Span Suspension Bridges, Advances in Mechanics, Mar. 25, 2011, pp. 123-132, vol. 41, No. 2, China Academic Journal Electronic Publishing House.

* cited by examiner

B-B

WIND-RESISTANT SUSPENSION BRIDGE

CROSS-REFERENCE TO RELATED APPLICATION

The present application is a continuation of international application of PCT application No. PCT/CN2021/114587 filed on Aug. 25, 2021, which claims the priority benefits of a China application No. 202010881881.8 filed on Aug. 27, 2020 and a China application No. 202110976112.0 filed on Aug. 24, 2021. The entirety of the above-mentioned patent applications are incorporated herein by reference and made a part of this specification.

TECHNICAL FIELD

The present application relates to the technical field of suspension bridge, and particularly relates to a wind-resistant suspension bridge.

DESCRIPTION OF RELATED ART

A bridge is a structure that allows pedestrians and vehicles to pass safely above the water surface. Therefore, when designing, it not only responds to the loads of people and vehicles, but also responds to external forces in the nature such as strong winds and earthquakes. Generally speaking, for suspension bridges, as the span increases, the amplitude of the swing also becomes larger, and the consideration of wind becomes more important.

Bridges mainly include beam bridges, arch bridges, rope-stayed bridges, suspension bridges, etc. Among these bridges, suspension bridges have many advantages compared with other bridges, such as a large span (up to nearly 2 kilometers), light weight, and economical material, short construction period, cost saving, good earthquake resistance, etc.

The suspension bridge suspends the entire bridge body through a suspension rope system. The bridge body in the main span length direction between the bridge towers is suspended in the air and has a long length, so the middle section of the bridge body has the poorest stability. The middle section of the bridge body is the middle part of the main span of the suspension bridge in the length direction. When strong winds are blowing, the suspension bridge is prone to undulating shake along the bridge axis direction and swing along the direction of the flowing water (perpendicular to the bridge axis). And, as the span of the bridge continues to increase, the flexibility of the bridge continues to increase, and the amplitude of the swing increases, making it more sensitive to wind excitation. Therefore, the impact of wind on the suspension bridge cannot be ignored.

How to reduce the shaking of the suspension bridge and enhance the wind resistance of the suspension bridge has always been a problem in the world of bridges.

SUMMARY

In order to improve the above-mentioned technical problem that the suspension bridge in the prior art is easy to shake, and to enhance the wind resistance of the suspension bridge, the present application provides a wind-resistant suspension bridge. The wind-resistant suspension bridge provided by the present application adopts the following technical solutions.

According to the object of the present invention, there is provided a wind-resistant suspension bridge, including a bridge tower, a bridge body, a main rope, a suspension rope and a guardrail. The suspension bridge further includes a wind-resistant rope, one end of which is connected to the bridge tower and the other end of which is connected to the main rope; the wind-resistant rope, the main rope and the bridge tower form a substantially triangle, the contact point between the bridge tower and the main rope, the connection point between the wind-resistant rope and the main rope, and the connection point between the wind-resistant rope and the bridge tower form the three vertices of the substantially triangle.

Preferably, one end of the wind-resistant rope is connected to the bridge tower through a damper, and the other end of the wind-resistant rope is connected to the main rope through a saddle clamp.

Preferably, the suspension bridge further includes an auxiliary rope provided above the main rope, and the auxiliary rope passes through the top of the bridge tower and both ends thereof are respectively anchored on the shore; the saddle clamp includes a main ring part for surrounding and clamping the main rope, an auxiliary ring part provided above the main ring part for surrounding and grasping the auxiliary rope, and a connecting part provided below the main ring part for connecting the suspension rope or for connecting both the suspension rope and the wind-resistant rope, and the main ring part and the auxiliary ring part are formed as a whole.

Preferably, the main ring part includes two first half rings with a semicircular cross section, and a horizontal first through hole is provided below the main ring part to make the two half rings of the main ring part connected together by a bolt and a nut provided in the through hole so as to form a complete ring and clamp the main rope;

the auxiliary ring part includes two second half rings with a semicircular cross section, and a horizontal second through hole is provided below the auxiliary ring part and above the main ring part to make the two half rings of the auxiliary ring part connected together by a bolt and a nut provided in the through hole so as to form a complete ring and grasp the auxiliary rope;

the saddle clamp further includes a cushion sleeve sleeved on the auxiliary rope and a tightening pipe tightening the auxiliary rope, one end surface of the cushion sleeve abuts against one end surface of the auxiliary ring part, and the other end surface of the cushion sleeve abuts against one end surface of the tightening pipe; for the saddle clamp where the connecting part only connects the suspension rope, the cushion sleeve and the tightening pipe are provided only at an end of the auxiliary ring part away from the bridge tower; for the saddle clamp where the connecting part connects both the suspension rope and the wind-resistant rope, the cushion sleeve and the tightening pipe are provided at both ends of the auxiliary ring part.

Preferably, the wind-resistant rope includes a long rope and a short rope, and each of the bridge tower is connected with two short ropes and one long rope, two short ropes are provided symmetrically in the length direction of the bridge with respect to the bridge tower, and the short ropes are connected at a position of the bridge tower at the same horizontal plane as the bridge deck, the long rope is connected to the root of the bridge tower, the projections of the connection points between the long rope and the short rope and the main rope on the bridge deck divide the length of the bridge body from the bridge tower to the main span length direction centerline roughly into three equal parts.

Preferably, the suspension bridge includes a counterweight device that can adjust the position of a counterweight block along the bridge length direction and the vertical direction, and the counterweight device includes a rail, a horizontal drive mechanism, the counterweight block and a counterweight suspension frame, the rail extending along the bridge length direction is fixedly provided below the bridge body, the horizontal drive mechanism includes a winch, a fixed pulley and a traction rope symmetrically provided with respect to the main span length direction centerline; the winch is fixed at the bridge tower at one end of the rail below the bridge body on the side facing the river bank, and the fixed pulley is fixed at the other end of the rail at a position of the main span length direction centerline, the traction rope is connected to the winch and surrounds the fixed pulley so as to drive the counterweight suspension frame connected with the traction rope to move along the rail, the counterweight suspension frame is movably suspended on the rail along the bridge length direction; the counterweight block is provided on the counterweight suspension frame so as to be located at the lower portion of the counterweight device; the counterweight suspension frame further includes a hydraulic device so as to adjust the position of the counterweight block vertically with the help of the hydraulic device.

Preferably, the suspension bridge further includes a hanger rod provided in the middle section of the bridge body and fixed integral with the bridge body, the upper end of the hanger rod extends upwards from the bridge deck over the height of the guardrail and is connected to the lower end of the suspension rope, and the lower end of the hanger rod extends downwards from the bridge deck, penetrates the bridge body and is connected to the bottom of the bridge body.

Preferably, the suspension bridge further includes a first set of diagonal struts extending upwards obliquely from the bridge deck towards the hanger rod to be connected with the hanger rod, and the vertical plane on which the first set of diagonal struts is located extends along the bridge length direction and is located on the side of the hanger rod away from main span length direction centerline.

Preferably, the suspension bridge further includes a support plate extending outwards horizontally from the bridge deck along the bridge width direction, a second set of diagonal struts and a third set of diagonal struts, the second set of diagonal struts extends upwards obliquely from the support plate toward the hanger rod to be connected with the hanger rod; the third set of diagonal struts extends downwards obliquely from the support plate toward the bridge body to be connected with the bridge body, and the second set of diagonal struts and the third set of diagonal struts are located outside the guardrail.

Preferably, the suspension bridge further includes an upper slope provided at the edge of the bridge deck outside the guardrail along the bridge width direction, and a lower slope provided at the bottom edge of the bridge body along the bridge width direction, the upper slope extends downwards obliquely from the edge of the bridge deck in the bridge width direction away from the bridge body, and when it extends to about two-fifths of the thickness of the bridge body from top to bottom, it extends downwards obliquely toward the bridge body to the bottom of the bridge body, thereby forming a harp corner at both ends of the cross section of the bridge body.

By adopting the above technical solutions, various measures have been taken in the main span of the suspension bridge to enhance the stability of the suspension bridge.

DESCRIPTION OF THE EMBODIMENTS

In order to make the purpose, technical solution and advantages of the present application embodiment clearer, the technical solution in the present application embodiment will be clearly and completely described below in conjunction with the drawings in the present application embodiment. Obviously, the described embodiments are part of the present application, rather than all of the embodiments. Based on the present application, all other embodiments obtained by those of ordinary skill in the art without creative work belong to the scope of protection of the present application.

Figure 1:
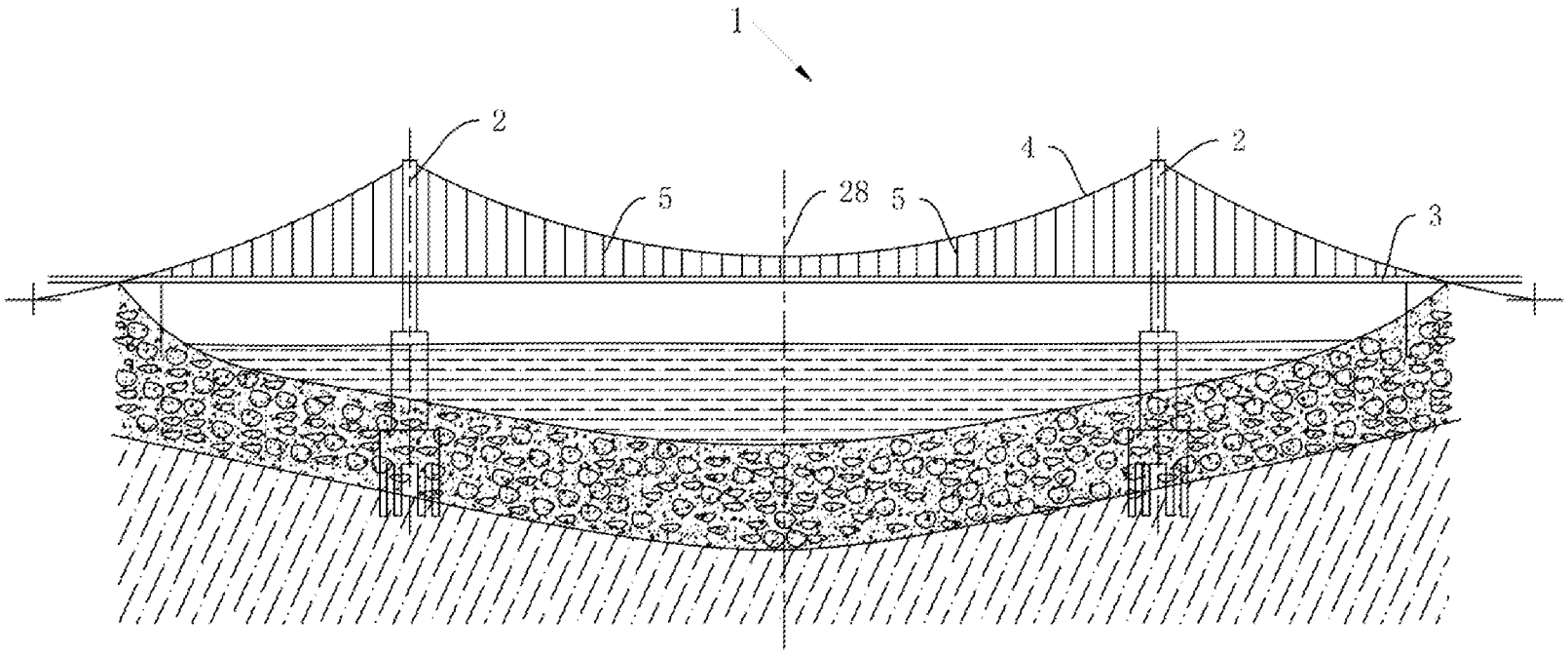
FIG. 1 is a main view of an existing suspension bridge.

FIG. 1 shows an existing traditional suspension bridge 1, which mainly includes a bridge tower 2, a main rope 4, a bridge body 3, a guardrail 6, etc. Four bridge towers 2 are symmetrically arranged relative to a main span length direction centerline 28 and a width direction centerline respectively. The main rope 4 is provided above the bridge body 3.

The main rope 4 is connected to the bridge body 3 with suspension ropes 5. The main rope 4 passes through the top of the bridge tower 2 along the bridge length direction, and two ends of the main rope 4 are anchored at anchorages on the shore, so that the bridge body 3 can be suspended from the main rope 4 by the suspension rope 5. Since the bridge body 3, especially the middle section of the main span portion of the bridge body 3, is suspended in the air, in case of strong winds, the suspension bridge 1 is prone to undulating shaking along the main span length direction or swing shaking along the width direction.

Figure 2:
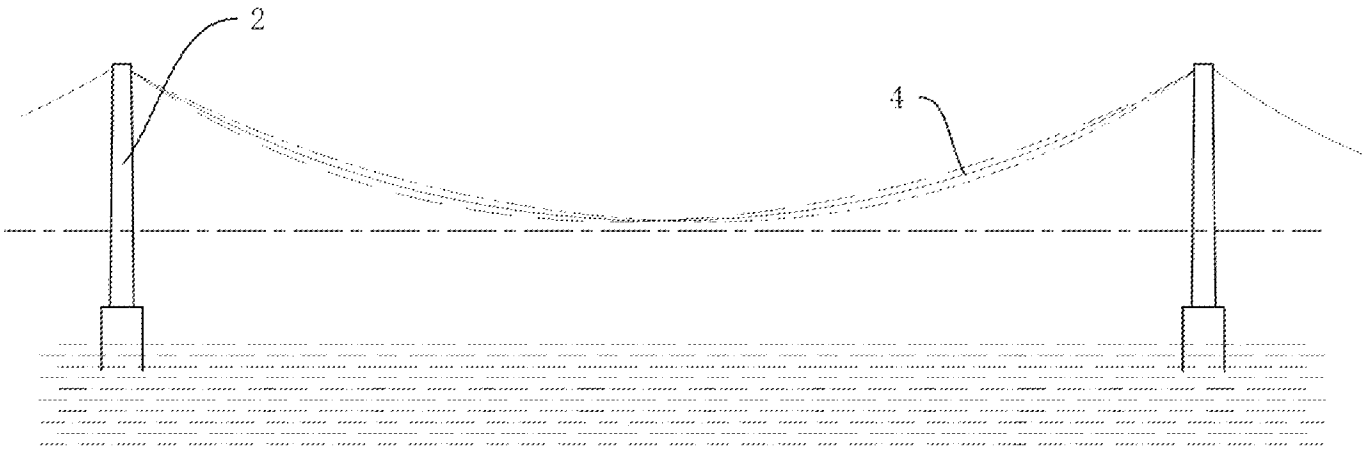
FIG. 2 is a schematic diagram illustrating that an existing suspension bridge has a fluctuation of shaking up and down in the direction of the center line along the width direction of the bridge when the suspension bridge encounters strong wind.

Referring to FIG. 2, for a traditional suspension bridge 1, the solid line represents the main rope 4 in a state without wind, and the dashed line represents the main rope 4 in a shaking state due to a strong wind. As shown in the drawing, when the air pressure above the bridge body 3 on the left side of the suspension bridge 1 is lower than the air pressure below the bridge body 3, the part of the main rope 4 on the left side of the main span length direction centerline 28 is shaken upwards (as shown by the dashed double-dotted line), and the right part is shaken downwards (as shown by the dashed double-dotted line); when the air pressure above the bridge body 3 on the right side of suspension bridge 1 is lower than the air pressure below the bridge body 3, the part of the main rope 4 on the right side of the main span length direction centerline 28 is shaken upwards (as shown by the short dashed line), and the left part is shaken downwards (as shown by the short dashed line). In the above two cases, the main rope 4 undulates between two contact points with the bridge tower 2.

In order to improve wind resistance, the present application provides a suspension bridge 1 as described below.

1. Wind-Resistant Rope 7

A wind-resistant rope 7 includes a long rope 71 and a short rope 72. Two short ropes 72 and one long rope 71 are provided respectively for each bridge tower 2. Therefore, the suspension bridge 1 according to the present application includes eight short ropes 72 and four long ropes 71.

One end of the long rope 71 is connected to the bridge tower 2 via a damper 8. The damper 8 is provided at the root of the bridge tower 2 to act as cushioning when the wind-resistant rope 7 is subjected to a greater tension, which also makes the main rope 4 has a certain degree of freedom (the main rope 4 can be shaken within a certain swing amplitude), thereby improving the stability of the main rope 4. The other end of the long rope 71 is connected to the main rope 4 of the main span of the suspension bridge via a saddle clamp 9 provided, which will be described in detail later.

One end of the short rope 72 is also connected to the bridge tower 2 via a damper 8. The damper 8 connected to the short rope 72 is provided at a position of the bridge tower 2 at the same level as the bridge deck 56. The other end of the short rope 72 is also connected to the main rope 4 via a saddle clamp 9 provided. For each bridge tower 2, the corresponding two short ropes 72 are symmetrically arranged with respect to the bridge tower 2 in the bridge length direction.

Figure 3:
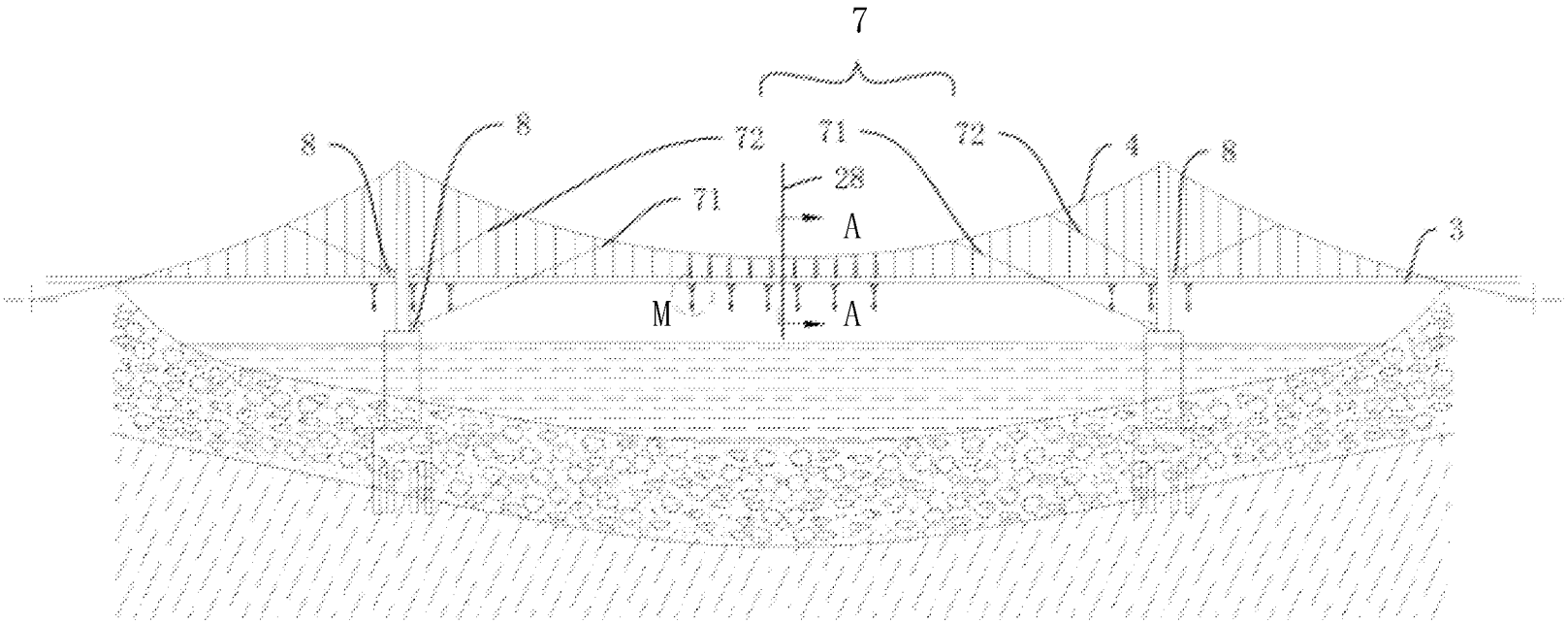
FIG. 3 is a main view of a wind-resistant suspension bridge according to the present application.
Figure 4:
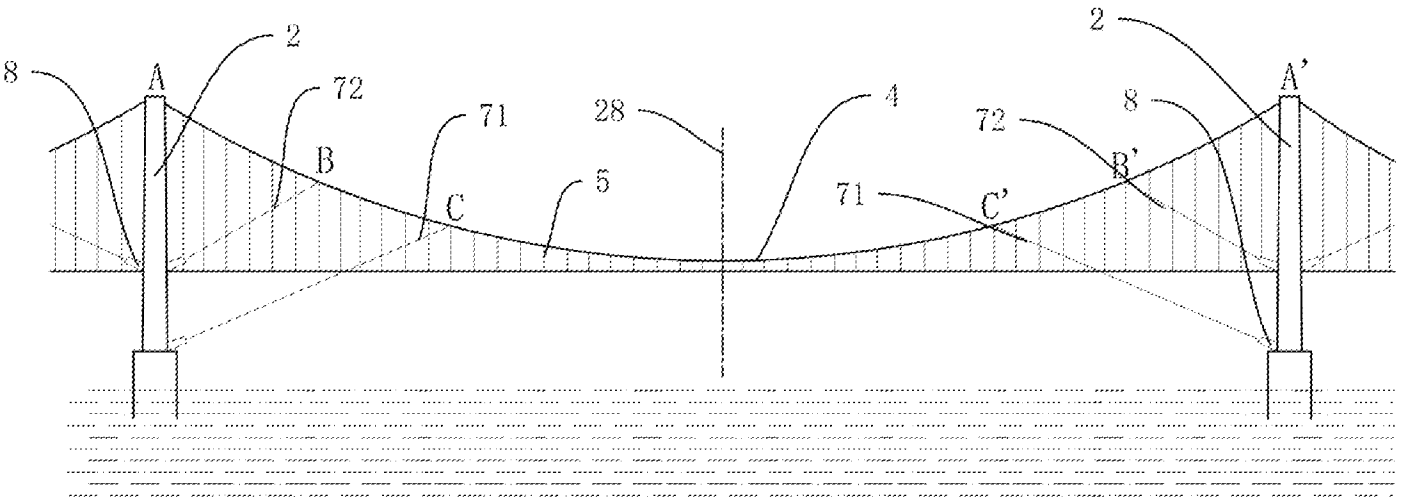
FIG. 4 is a schematic diagram of wind-resistant ropes of the suspension bridge according to the present application.

In this case, as shown in FIGS. 3 and 4, in the length range of the bridge body 3 from the bridge tower 2 to the main span length direction centerline 28, projections of connection points, at which the long rope 71 and the short rope 72 are connected to the main rope 4, on the bridge deck 56 divide this part of the bridge body 3 roughly into three equal parts.

The long rope 71 or the short rope 72 respectively form a substantially triangle with the bridge tower 2 and the main rope 4 to enhance stability. Therefore, By means of the wind-resistant ropes 7, in case of a strong wind, the wave undulating and other shaking of the main rope 4 can be restricted, thereby improving the wind resistance of the suspension bridge 1. Specifically, as shown in FIG. 4, point A, point B, and the connection point at which the short rope 72 is connected to the bridge tower 2 substantially form a triangle; similarly, point A, point C, and the connection point at which the long rope 71 is connected to the bridge tower 2 substantially form a triangle. Similarly, point A', point B', and the connection point at which the short rope 72 is connected to the bridge tower 2 substantially form a triangle; point A', point C', and the connection point at which the long rope 71 is connected to the bridge tower 2 substantially form a triangle. Therefore, after the wind-resistant ropes 7 are provided on the suspension bridge 1, the main rope 4 of the main span has a total of six connection points A, B, C, A', B', and C' for controlling its shaking. Comparing with the prior art, the main rope 4 only has two points A and A'. Therefore, by providing the wind-resistant ropes 7, wave undulating and other shaking of the bridge body 3 along the bridge length direction can be effectively avoided.

2. Saddle Clamp 9

Figure 5A:
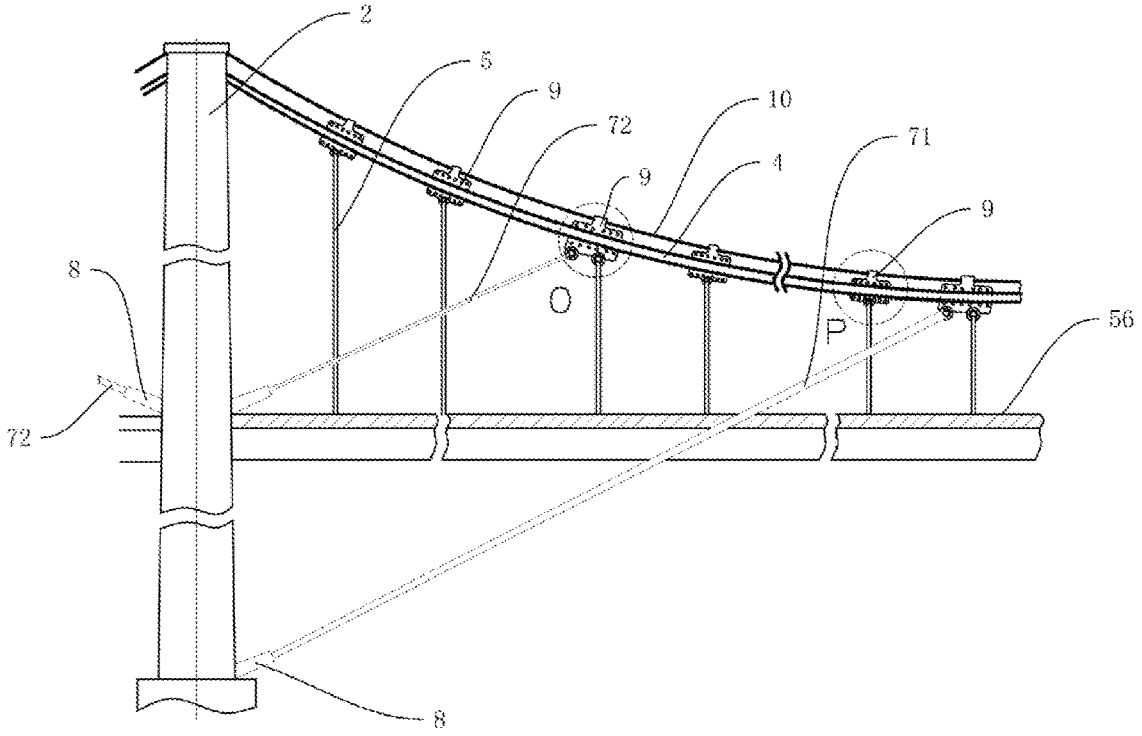
FIG. 5A mainly shows the suspension bridge and the wind-resistant ropes according to the present application.
Figure 5B:
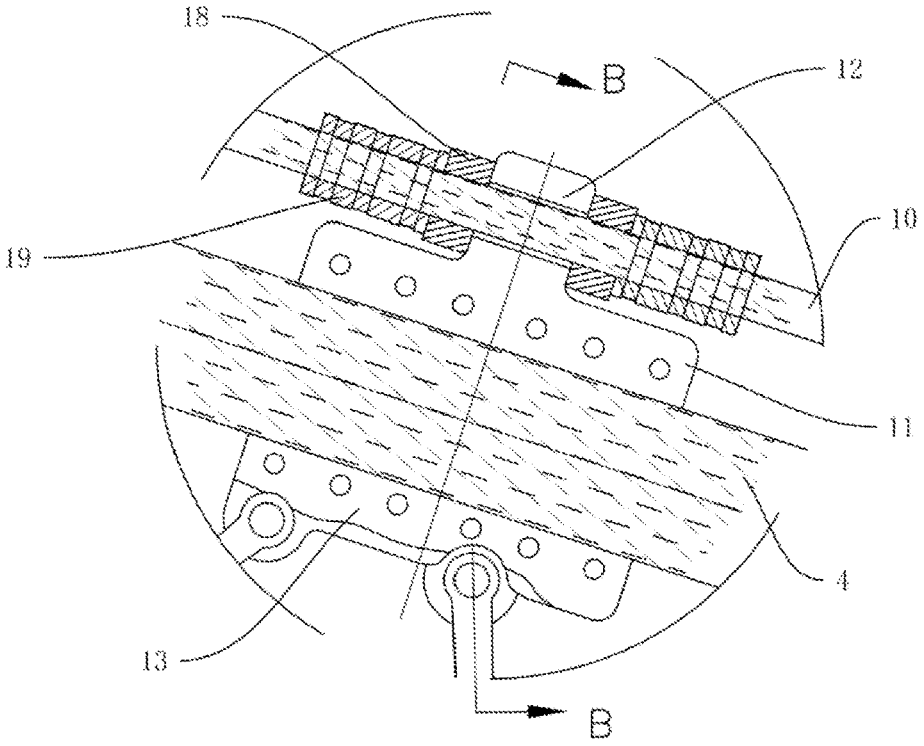
FIG. 5B is an enlarged view of the circle O in FIG. 5A.
Figure 5C:
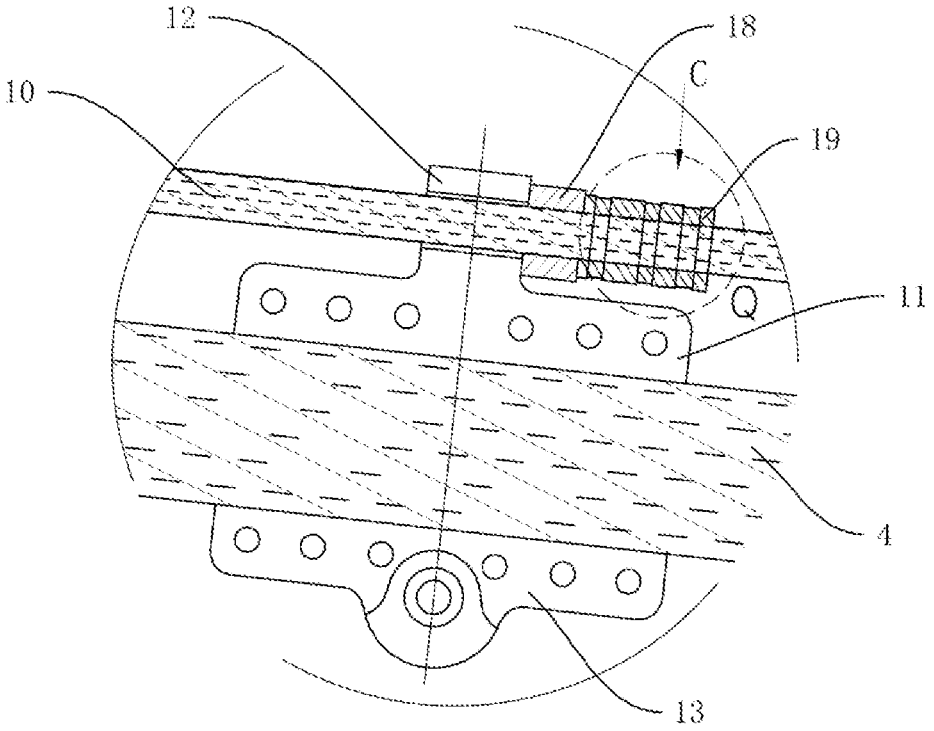
FIG. 5C is an enlarged view of the circle P in FIG. 5A.
Figure 5D:
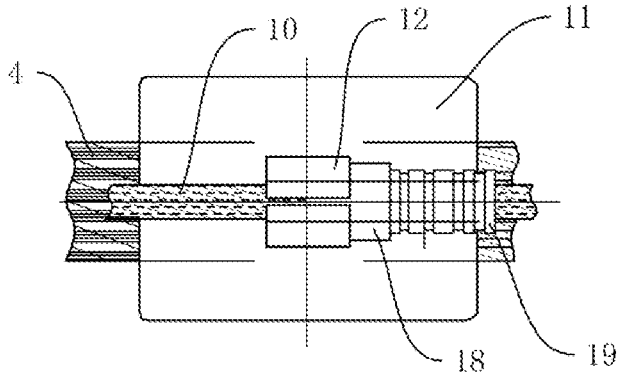
FIG. 5D is a view along a direction C in FIG. 5C.
Figure 5E:
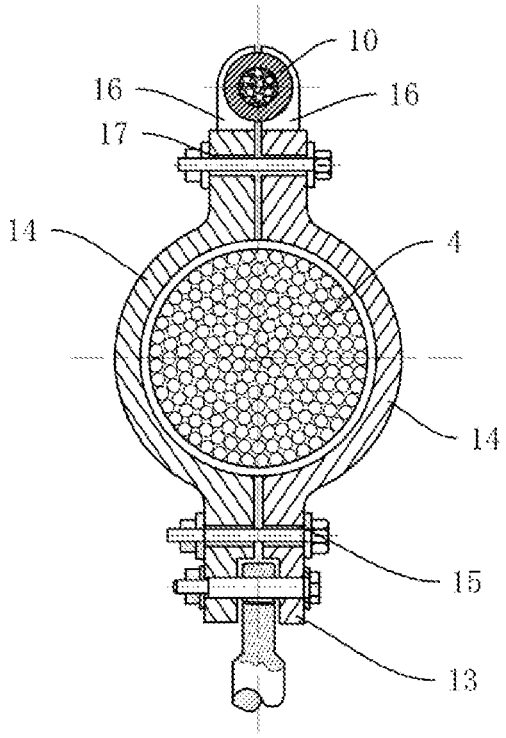
FIG. 5E is a cross-sectional view along the line B-B in FIG. 5B.
Figure 5F:
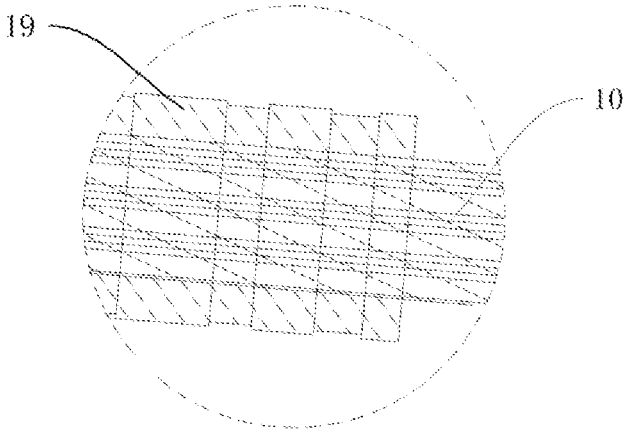
FIG. 5F is an enlarged view of the circle Q in FIG. 5C.

Referring to FIGS. 5A-5C and 5E, an auxiliary rope 10 and saddle clamps 9 are shown. The auxiliary rope 10 is provided above the main rope 4, also passes through the top of the bridge tower 2, and both ends thereof are respectively anchored on the shore. A conventional saddle clamp 9 or lock clamp used for the main rope 4 of the suspension bridge 1 mainly includes a main ring part 11 surrounding and clamping on the main rope 4. Compared to the conventional saddle clamp 9 or lock clamp, the saddle clamp 9 in this embodiment includes an auxiliary ring part 12 provided above the main ring part 11, which is formed integrally with the main ring part 11. The auxiliary ring part 12 surrounds and clamps the auxiliary rope 10. In addition, a connecting part 13 is provided below the main ring part 11 for connecting the suspension rope 5 (as shown in FIG. 5C) or for connecting both of the suspension rope 5 and the wind-resistant rope 7 (as shown in FIG. 5B).

The main ring part 11 includes two half rings 14 with a semicircular cross section, and horizontal through holes 15 are provided at the lower part of the main ring part 11. The two half rings of the main ring part 11 are connected together by bolts and nuts provided in the through holes so as to form a complete ring and clamp the main rope 4.

The auxiliary ring part 12 includes two half rings 16 with a semicircular cross section, and horizontal through holes 17 are provided at the lower part of the auxiliary ring part 12 and at the upper part of the main ring part 11. The two half rings of the auxiliary ring part 12 are connected together by bolts and nuts provided in the through holes so as to form a complete ring and clamp the auxiliary rope 10.

The saddle clamp 9 further includes a cushion sleeve 18 sleeved on the auxiliary rope 10 and a tightening pipe 19 tightening the auxiliary rope 10. One end surface of the cushion sleeve 18 abuts against one end surface of the auxiliary ring part 12, and the other end surface of the cushion sleeve 18 abuts against one end surface of the tightening pipe 19, as shown in FIGS. 5A-5C. For the saddle clamp 9 of which the connecting part 13 only connects to the suspension rope 5, the cushion sleeve 18 and the tightening pipe 19 are provided only at an end away from the bridge tower 2, so as to prevent the saddle clamp 9 from sliding towards the main span length direction centerline 28. For the saddle clamp 9 of which the connecting part 13 connects to both the suspension rope 5 and the wind-resistant ropes 7, the cushion sleeve 18 and the tightening pipe 19 are provided at both ends thereof, so as to prevent the saddle clamp 9 connected with the wind-resistant ropes 7 from sliding towards the bridge tower 2. Preferably, the saddle clamp 9 is connected to the wind-resistant rope 7 via pin holes and pins.

The saddle clamp 9 clamps the main rope 4 and the auxiliary rope 10, so that the wind-resistant rope 7 is fixedly connected to the main rope 4, thereby enhancing the stability of the suspension bridge 1 in the case of strong winds.

3. Counterweight Device 20

Figure 6:
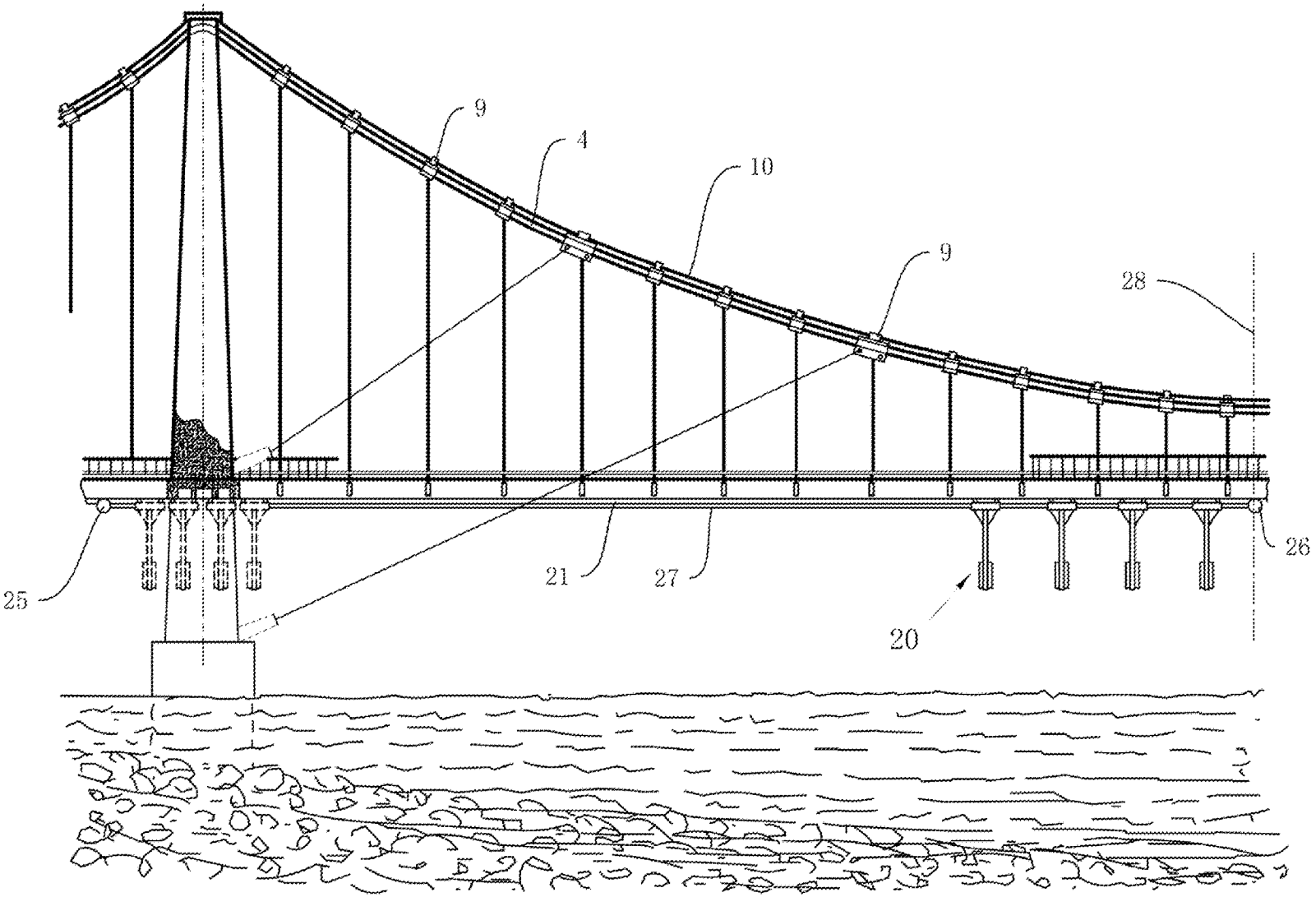
FIG. 6 mainly shows a counterweight device of the suspension bridge according to the present application.

As shown in FIG. 6, in the present application, counterweight devices 20 are provided below the bridge body 3 of the suspension bridge 1, which can adjust the positions of counterweight blocks 23 along the main span length direction and the vertical direction. A counterweight device 20 includes a counterweight block 23, a rail 21, a horizontal drive mechanism 22, and a counterweight suspension frame 24 that adjusts the position of the counterweight block 23 in the vertical direction, and so on.

Figure 7A:
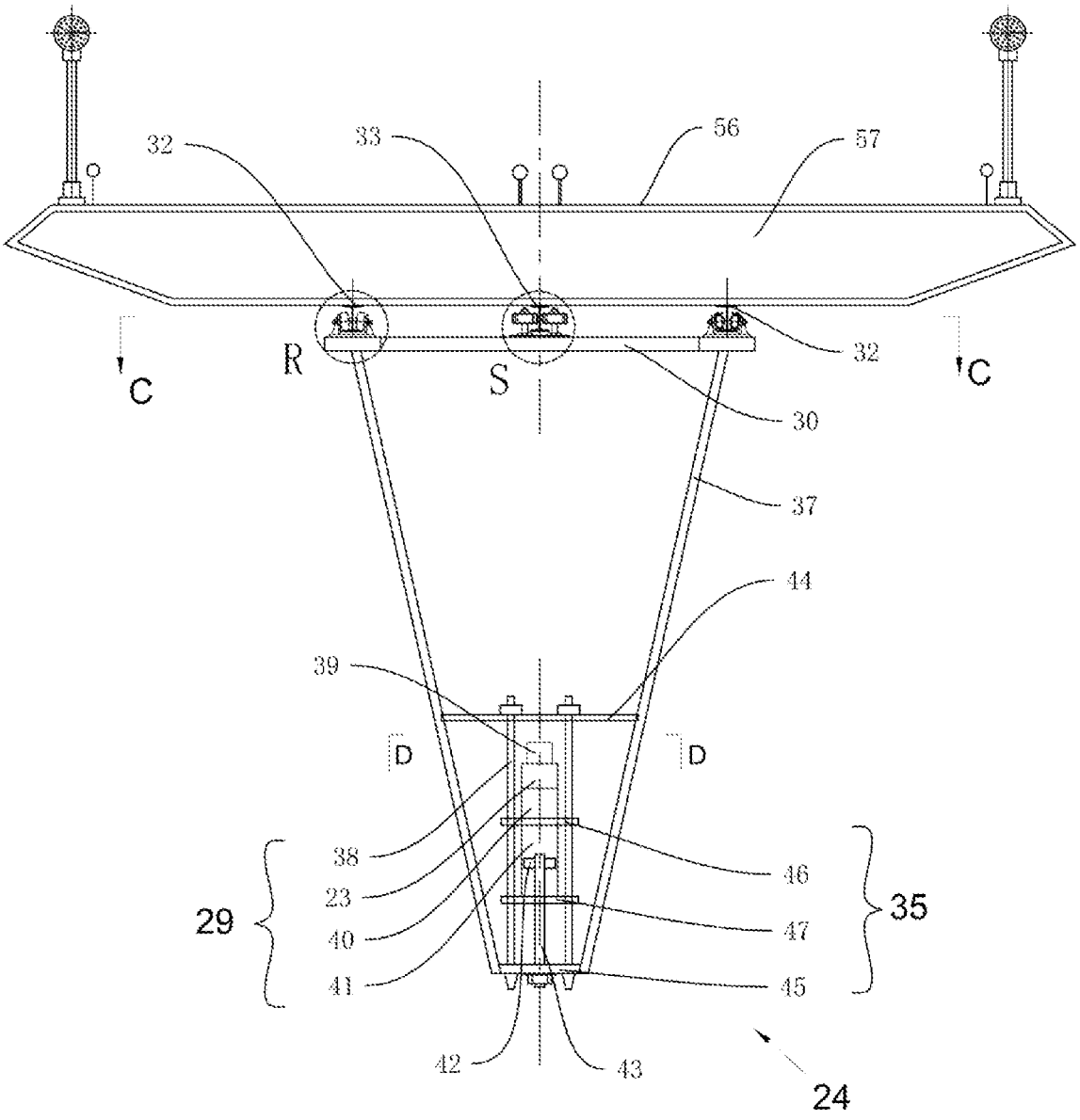
FIG. 7A is a cross-sectional view along the line A-A in FIG. 3.
Figure 7B:
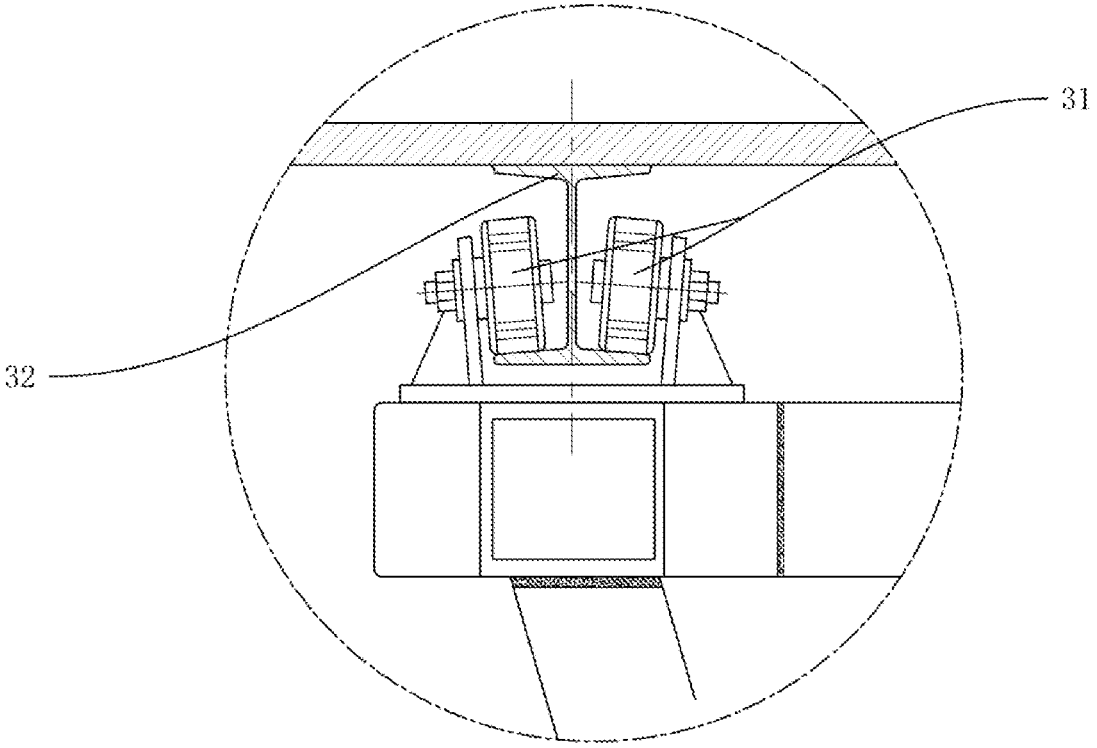
FIG. 7B is an enlarged view of the circle R in FIG. 7A.
Figure 7C:
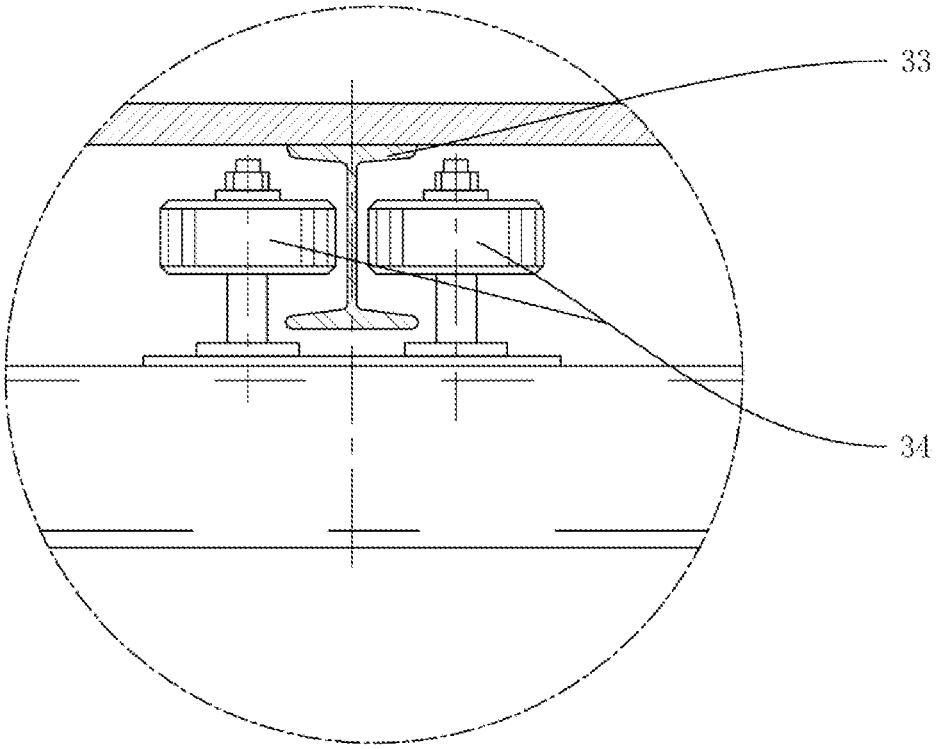
FIG. 7C is an enlarged view of the circle S in FIG. 7A.
Figure 7D:
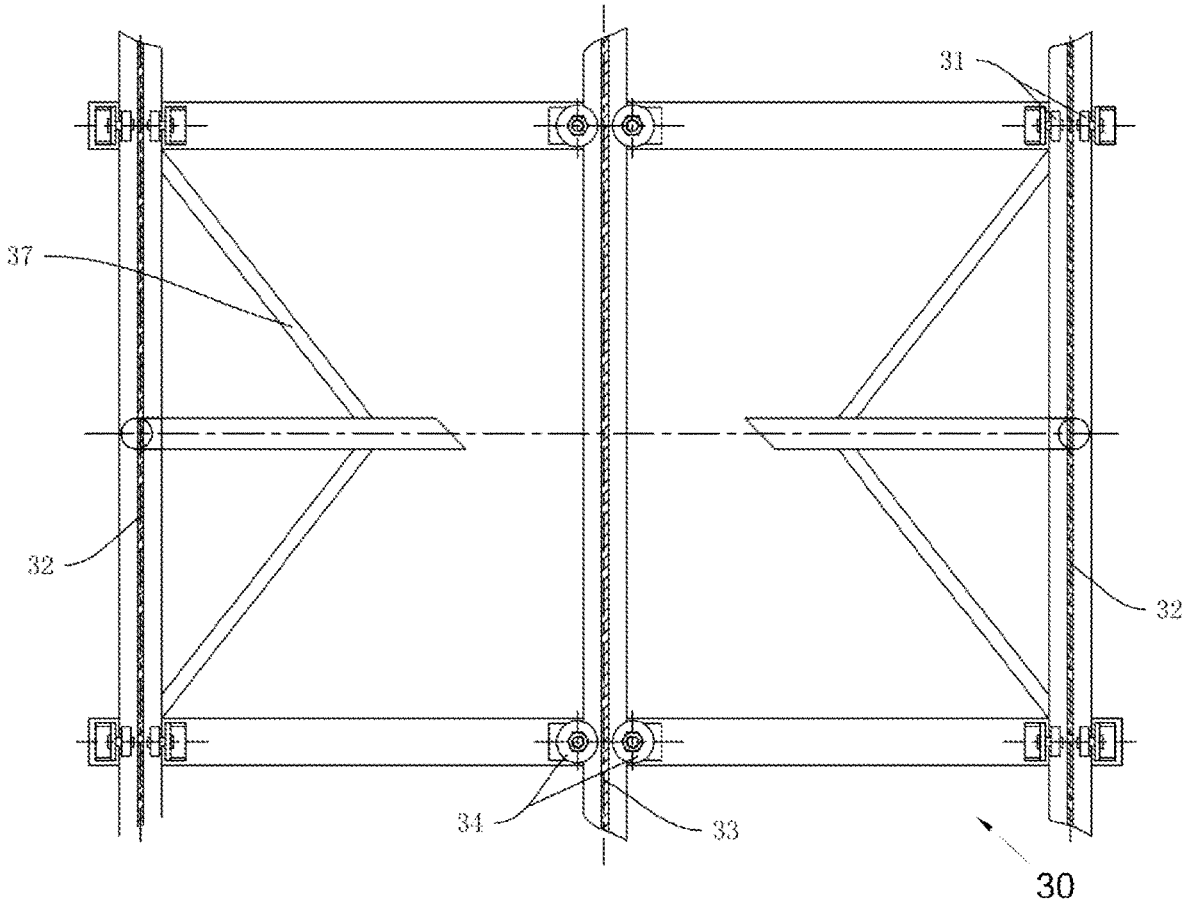
FIG. 7D is a cross-sectional view along the line C-C in FIG. 7A.
Figure 7E:
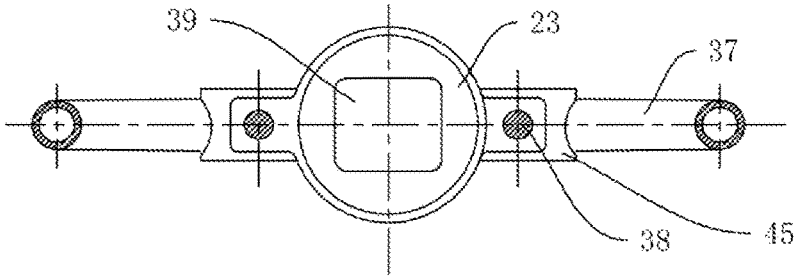
FIG. 7E is a cross-sectional view along the line D-D in FIG. 7A.
Figure 7F:
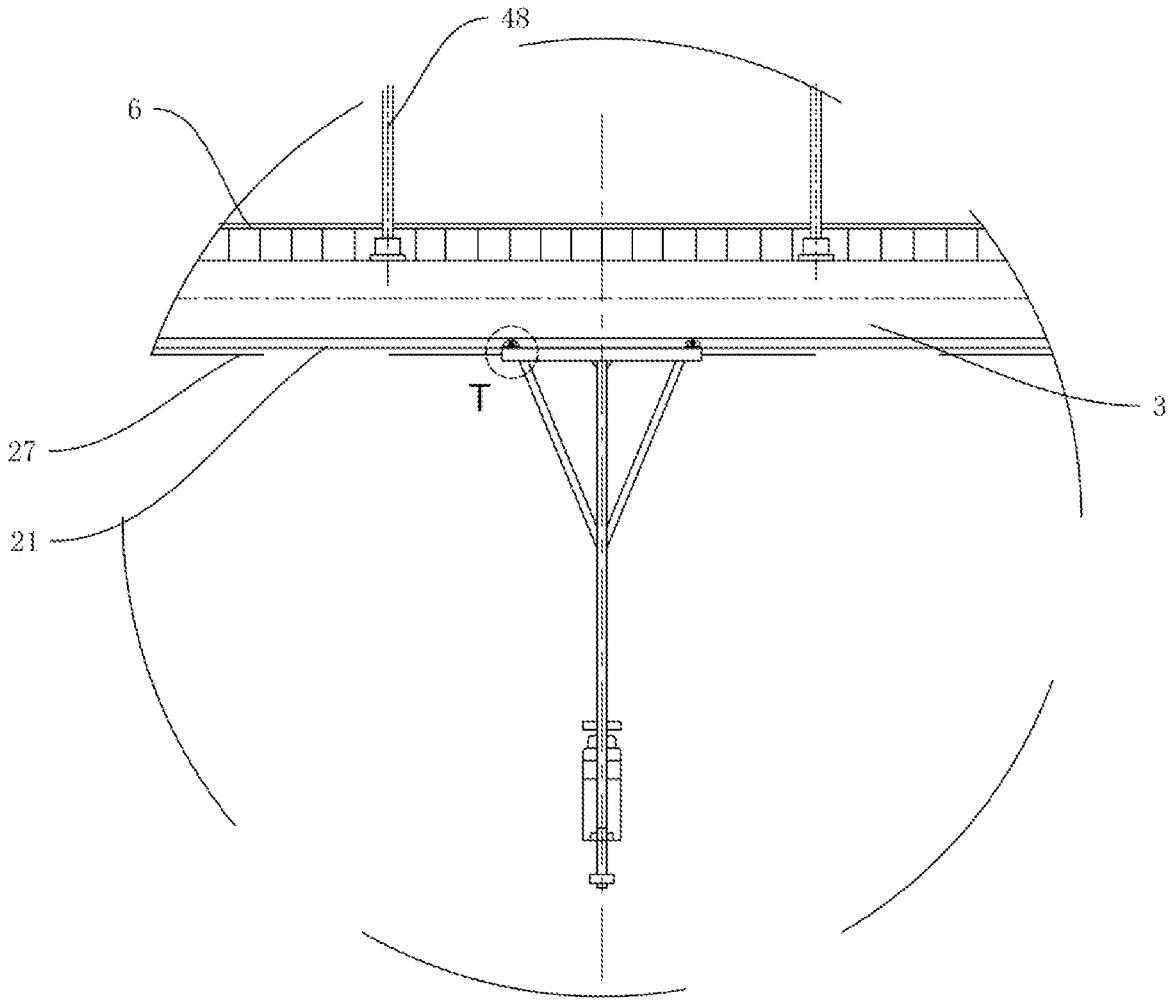
FIG. 7F is an enlarged view of the circle M in FIG. 3.
Figure 7G:
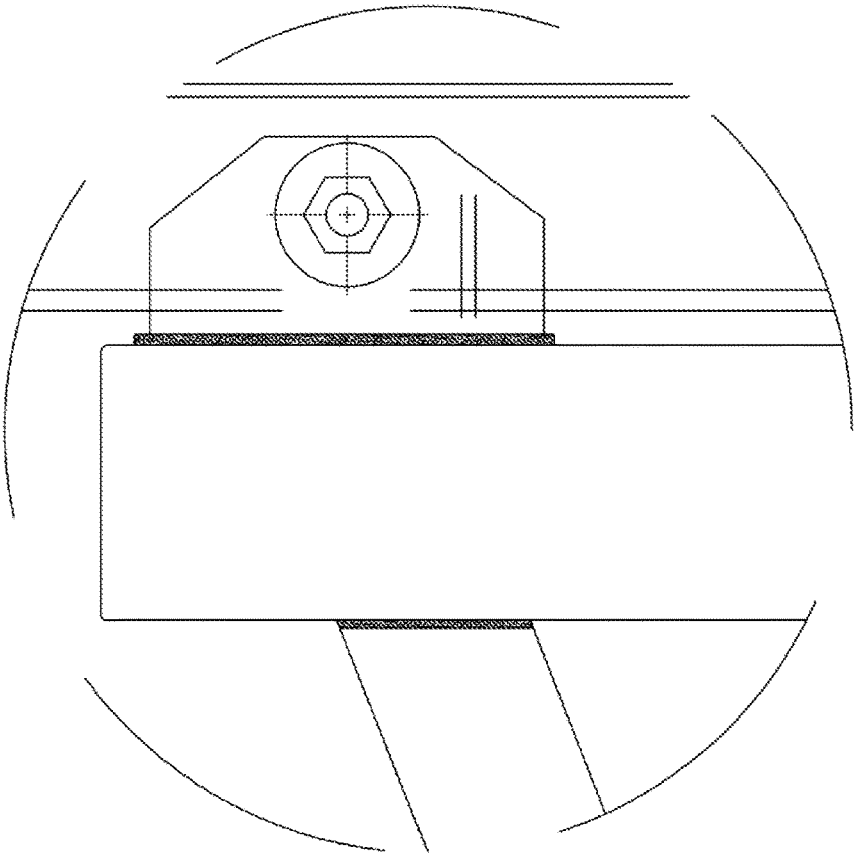
FIG. 7G is an enlarged view of the circle T in FIG. 7F.

The rail 21 extends along the main span length direction and is fixedly arranged below the bridge body 3. The rail 21 includes two load-bearing rails 32 that are arranged in parallel in the same horizontal plane and one guide rail 33. The guide rail 33 is equidistantly arranged between the two load-bearing rails 32, as shown in FIGS. 7A and 7D.

The horizontal drive mechanism 22 includes winches 25, fixed pulleys 26 and traction ropes 27 etc., which are respectively symmetrically arranged with respect to the main span length direction centerline 28. The winch 25 is fixed to one end of the rail 21 underneath the bridge body 3 at one side facing the river bank of the bridge tower 2. The fixed pulley 26 is fixed to the other end of the rail 21 at the main span length direction centerline 28. The traction rope 27 is connected to the winch 25 and surrounds the fixed pulley 26 so as to drive the counterweight suspension frame 24 connected with the traction rope 27 to move along the rail 21, as shown in FIG. 6 and FIG. 7A.

The counterweight suspension frame 24 is movably suspended on the rail 21 along the main span length direction. The counterweight block 23 is fixed in the counterweight suspension frame 24 so as to be located at the lower portion of the counterweight device 20. The lower portion of the counterweight suspension frame 24 is provided with a hydraulic device 29, so that the position of the counterweight block 23 can be adjusted vertically by the hydraulic device 29. Specifically, the counterweight suspension frame 24 includes a rectangular truss 30 at the upper portion, as shown in FIG. 7A. Two first rollers 31 are arranged vertically on each corner of the truss 30, as shown in FIG. 7B. By means of the two first rollers 31 vertically arranged, each corner is movably connected to the load-bearing rail 32. A guide rail 33 is located on an axis of the main span length direction at the bottom of the bridge body 3. Along the bridge width direction, at the position corresponding to the guide rail 33, two second rollers 34 are horizontally arranged on the truss 30 between the two corners for guiding the movement of truss 30, as shown in FIG. 7C. With the above structure, the counterweight suspension frame 24 can move horizontally along the main span length direction below the bridge body 3. Without wind or with small wind, the counterweight suspension frame 24 can be moved to be placed at the lower portion of the bridge tower 2. With strong wind, the counterweight suspension frame 24 can be moved to a proper position in the middle section of the main span of the suspension bridge, and fixed to the proper position by a locking device (not shown) provided on the load-bearing rail 32.

The counterweight suspension frame 24 further includes a fixed frame 35 and a counterweight vertical adjustment mechanism that are provided below the truss 30. As shown in FIG. 7A, the fixed frame 35 includes two suspension frame main pipes 37 that are obliquely arranged relative to the vertical direction. The counterweight vertical adjustment mechanism is arranged on the fixed frame 35. The counterweight block 23 is fixed on the counterweight vertical adjustment mechanism. As shown in FIG. 7A, the counterweight vertical adjustment mechanism preferably includes a hydraulic device 29 installed at the lower portion of the counterweight suspension frame 24, and specifically includes a sliding guide rod 38, an oil motor 39, an oil tank 40, an oil cylinder 41, a piston 42, a piston rod 43, and an upper positioning plate 44 and a lower positioning plate 45 for the sliding guide rod, an oil cylinder 41, a sliding upper plate 46 and a lower plate 47, etc. When the oil motor 39 operates, with pushing the piston 42 by the oil, the oil motor 39, the counterweight block 23, the oil tank (pool) 40, and the oil cylinder 41 move up and down along the two sliding guide rods 38. In this way, the height of the center of gravity of the counterweight suspension frame 24 can be adjusted, that is, the swing frequency of the pendulum is changed by adjusting the length of the swing arm. Since the suspension frame is fixed with the bridge body 3 as a whole, by adjusting the swing (vibration) frequency of the bridge body 3, the periodic vibration of the bridge body 3 due to external forces such as vortex vibration can be disturbed, thereby avoiding resonating of the bridge body 3 due to external forces.

The parameters such as weight, size, quantity, etc., of the counterweight suspension frame 24 can be determined according to the actual situation of the suspension bridge 1. Generally, each counterweight suspension frame 24 weighs about 1 to 4 tons, and the number is 6 to 12. A plurality of counterweight suspension frames 24 are connected together at equal intervals along the main span length direction. The plurality of counterweight suspension frames 24 are located in the middle section of the main span of the suspension bridge along the main span length direction.

The above configuration ensures that the height of the center of gravity of the counterweight suspension frame 24 can be adjusted within a certain range in the vertical direction, so that the vibration frequency of the bridge body 3 can be adjusted at any time.

The operating process of the counterweight suspension frame 24 is as follows, see FIGS. 6 and 7A:

(1) without wind or with a small wind, the counterweight suspension frame 24 is placed below the bridge tower 2 (a unloading device is required).

(2) with a strong wind, the winch 25 pulls the suspension frame along the rail 21 with the ropes and the fixed pulley 26 to a suitable position in the middle section of the main span of the suspension bridge and locks the suspension frame along the rail 21. At this time, heavy vehicles are forbidden to pass the bridge, and surface ships are reminded to avoid the counterweight suspension frame 24.

(3) with a very strong wind, all vehicles are forbidden to pass the bridge deck 56, and preferably, large boats in the waterway are forbidden to pass the bridge at the same time.

(4) the heights of the center of gravity of the counterweight blocks 23 of the counterweight suspension frames 24 are different to avoid resonance at the same time.

4. Hanger Rod Assembly

Figure 8:
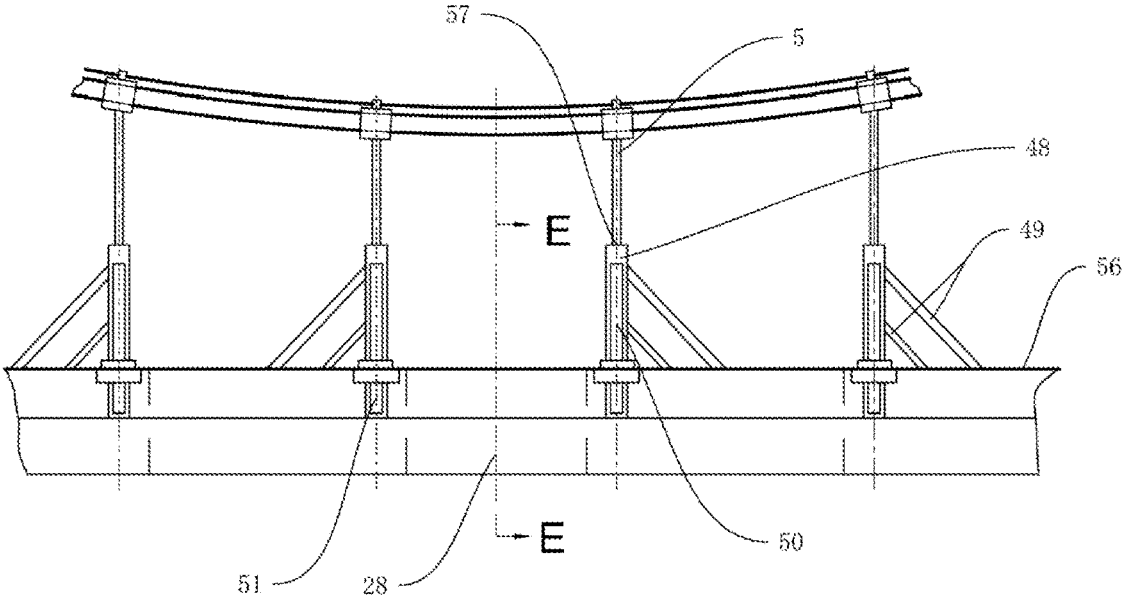
FIG. 8 mainly shows a hanger rod and other components of the suspension bridge according to the present application.
Figure 9:
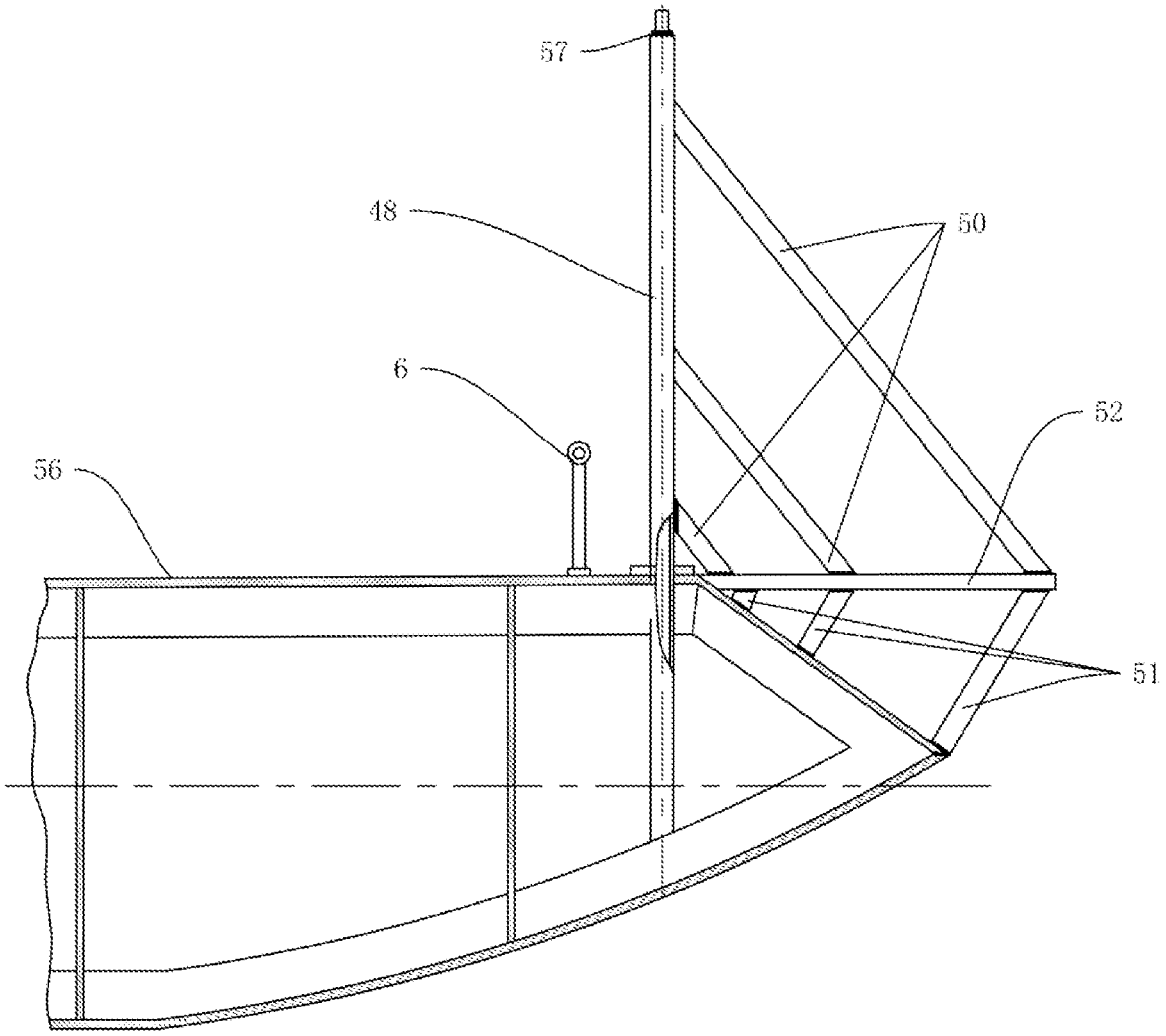
FIG. 9 is a cross-sectional view along the line E-E in FIG. 8.

Referring to FIGS. 8-9, a hanger rod assembly is shown. Each suspension rope 5 is connected to the bridge body 3 via a hanger rod assembly. The hanger rod assembly includes a hanger rod 48, diagonal struts and support plate 52 etc., which are arranged in the middle section of the main span of the bridge and fixed integrally with the bridge body 3. The hanger rod 48 is located outside the guardrail 6. The range of the bridge deck 56 where the hanger rod 48 is provided is located in the middle section of the main span and occupies about one-fifth of the length of the main span of the suspension bridge. An upper end of the hanger rod 48 extends upwards from the bridge deck 56 over the height of the guardrail 6 and is connected to the lower end of the suspension rope 5, and the lower end of the hanger rod 48 extends downwards from the bridge deck 56 to penetrate the bridge body 3 and is fixed to the bottom of the bridge body 3. As shown in FIG. 8, the hanger rod assembly includes a first set of diagonal struts 49. The first set of diagonal struts 49 includes two diagonal struts that extend upwards obliquely from the bridge deck 56 towards the hanger rod 48 to connect to the hanger rod 48. A vertical plane on which the first set of diagonal struts 49 is located extends along the main span length direction and is located on the side of the hanger rod 48 away from the main span length direction centerline 28. In addition, as shown in FIG. 9, the hanger rod assembly includes a support plate 52 extending outwards horizontally from the bridge deck 56 along the bridge width direction, a second set of diagonal struts 50 and a third set of diagonal struts 51. The second set of diagonal struts 50 includes three diagonal struts extending upwards obliquely from the support plate 52 toward the hanger rod 48 to connect to the hanger rod 48. The third set of diagonal struts 51 also includes three diagonal struts extending downwards obliquely from the support plate 52 toward the bridge body 3 to connect to the bottom of the bridge body 3. The second set of diagonal struts 50 and the third set of diagonal struts 51 are located outside the guardrail 6.

In this example, the hanger rod 48 is fixed to the bridge body 3, and the lifting point 57 of the suspension rope 5 is at the top of the hanger rod 48, so that the vertical distance between the center of gravity of the bridge body 3 and the lifting point 57 has increased a lot, compared with the traditional suspension bridge 1, because the traditional lifting point 57 is located on the bridge deck 56. The greater the vertical distance between the lifting point 57 and the center of gravity of the suspension bridge 1, the more stable and balanced the suspension bridge 1, and the less likely to vibrate and tilt or flip.

5. Wind Breaker and Tail Wing

An upper slope 53 is provided at the edge of the bridge deck 56 outside the guardrail 6 along the bridge width direction, and a lower slope 54 is provided at the bottom edge of the bridge body 3 along the bridge width direction, so that the cross section of the bridge body 3 of the suspension bridge 1 is generally streamlined.

Figure 10:
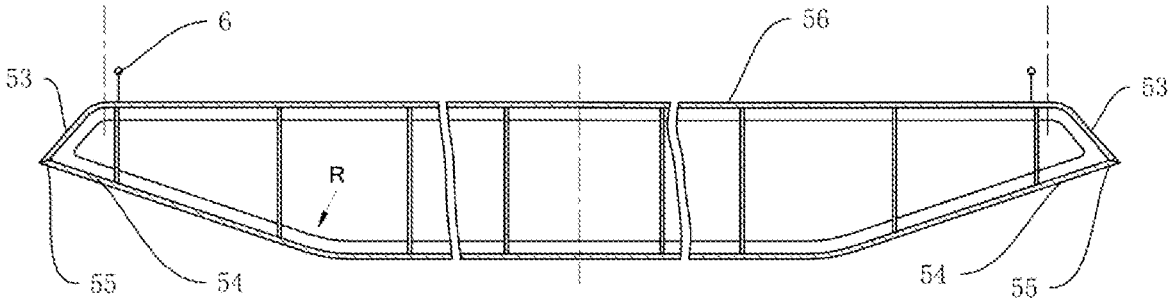
FIG. 10 shows a first embodiment of a cross-section of the bridge body according to the present application.
Figure 11:
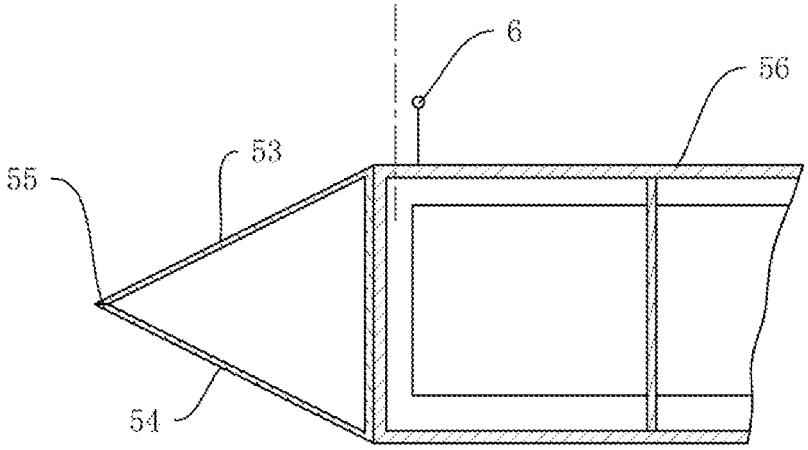
FIG. 11 shows a second embodiment of a cross-section of the bridge body according to the present application.
Figure 12:
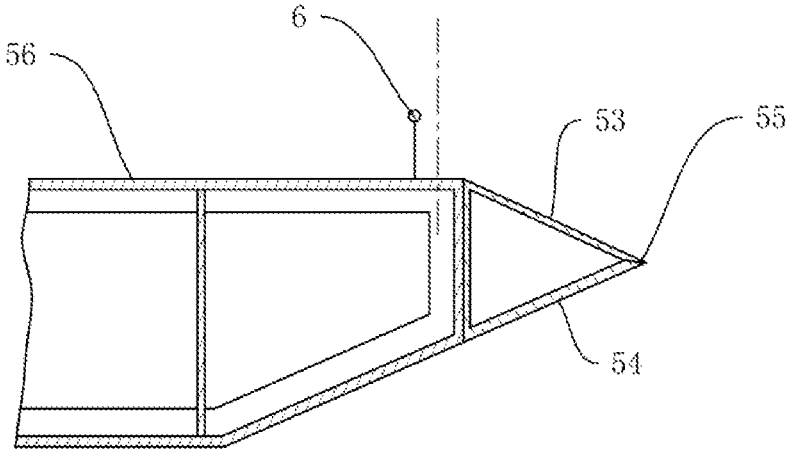
FIG. 12 shows a third embodiment of a cross section of the bridge body according to the present application.

As shown in FIG. 10, the upper slope 53 extends downwards obliquely from the edge of the bridge deck 56 away from the bridge body 3, and when it extends to about two-fifths of the thickness of the bridge body 3 from top to bottom, it extends downwards obliquely toward the bridge body 3 to the bottom of the bridge body 3, thereby forming a harp corner 55 at both ends of the cross section of the bridge body 3, thereby reducing the resistance of the bridge body 3 to the wind, as shown in FIGS. 10 to 12. The position of the apex of the harp corner 55 is determined by wind tunnel tests. The harp corner 55 forms a wind breaker when facing the direction of wind blowing, while the harp corner 55 forms a tail wing when facing away from the direction of wind blowing, so that the cross section of the bridge body 3 is generally streamlined. This streamlined structure greatly reduces the transverse impact force of the windward side of the bridge body 3 from the wind, and the vortex generated after the wind blows through the bridge body 3 can also be effectively reduced.

In summary, by providing the suspension bridge 1 with the above measures (especially the wind-resistant rope 7 and the counterweight device 20), the wind resistance of suspension bridge 1 is greatly improved, thus increasing safety. The utilization rate of the suspension bridge 1 will also be increased, and the service life is prolonged.

LIST OF REFERENCE SIGNS

1. suspension bridge; 2. bridge tower; 3. bridge body; 4. main rope; 5. suspension rope; 6. guardrail; 7. wind-resistant rope; 8. damper; 9. saddle clamp; 10. auxiliary rope; 11. main ring part; 12. auxiliary ring part; 13. connecting part; 14. first half ring; 15. first through hole; 16. second half ring; 17. second through hole; 18. cushion sleeve; 19. tightening pipe; 20. counterweight device; 21. rail; 22. horizontal drive mechanism; 23. counterweight block; 24. counterweight suspension frame; 25. winch; 26. fixed pulley; 27. traction rope; 28. centerline; 29. hydraulic device; 30. truss; 31. first roller; 32. load-bearing rail; 33. guide rail; 34. second roller; 35. fixed frame; 37. suspension frame main pipe; 38. sliding guide rod; 39. oil motor; 40. oil tank; 41. oil cylinder; 42. piston; 43. piston rod; 44. upper positioning plate; 45. lower positioning plate; 46. upper plate; 47. lower plate; 48. hanger rod; 49. first set of diagonal struts; 50. second set of diagonal struts; 51. third set of diagonal struts; 52. support plate; 53. upper slope; 54. lower slope; 55. sharp corner; 56. bridge deck; 57. lifting point; 71. long rope; 72. short rope.

What is claimed is:

1. A wind-resistant suspension bridge, comprising: a bridge tower, a bridge body, a main rope, a suspension rope and a guardrail, wherein, the suspension bridge further comprises a wind-resistant rope, a first end of the wind-resistant rope is connected to the bridge tower and a second end of the wind-resistant rope is connected to the main rope; the wind-resistant rope, the main rope and the bridge tower form a roughly triangle; contact points of the bridge tower with the main rope, connection points of the wind-resistant rope with the main rope, and connection points of the wind-resistant rope with the bridge tower form three vertices of the roughly triangle, wherein the first end of the wind-resistant rope is connected to the bridge tower via a damper, and the second end of the wind-resistant rope is connected to the main rope via a saddle clamp, and wherein the suspension bridge further comprises an auxiliary rope provided above the main rope, and the auxiliary rope passes through top of the bridge tower and both ends thereof are respectively anchored on shore; the saddle clamp comprises a main ring part for surrounding and clamping the main rope, an auxiliary ring part provided above the main ring part for surrounding and grasping the auxiliary rope, and a connecting part provided below the main ring part for connecting the suspension rope or for connecting both the suspension rope and the wind-resistant rope, and the main ring part and the auxiliary ring part are formed as a whole.

2. The wind-resistant suspension bridge according to claim 1, wherein the main ring part comprises two first half rings with a semicircular cross section, and first through holes are provided horizontally below the main ring part, the two half rings of the main ring part are connected together by bolts and nuts provided in the first through holes so as to form a complete ring and clamp the main rope;

the auxiliary ring part includes two second half rings with a semicircular cross section, and second through holes are provided horizontally below the auxiliary ring part and above the main ring part, the two half rings of the auxiliary ring part are connected together by bolts and nuts provided in the second through holes so as to form a complete ring and clamp the auxiliary rope;

the saddle clamp further includes a cushion sleeve sleeved on the auxiliary rope and a tightening pipe tightening the auxiliary rope, one end surface of the cushion sleeve abuts against one end surface of the auxiliary ring part, and the other end surface of the cushion sleeve abuts against one end surface of the tightening pipe; for a saddle clamp of which the connecting part only connects to the suspension rope, a cushion sleeve and a tightening pipe are provided only at an end of the auxiliary ring part away from the bridge tower; for a saddle clamp of which the connecting part connects to both the suspension rope and the wind-resistant rope, a cushion sleeve and a tightening pipe are provided at both ends of the auxiliary ring part.

3. The wind-resistant suspension bridge according to claim 1, wherein the wind-resistant rope comprises a long rope and a short rope, and each of the bridge tower is connected with two short ropes and one long rope, the two short ropes are provided symmetrically in a length direction of the bridge with respect to the bridge tower, and the short ropes are connected at a position of the bridge tower at the same horizontal plane as the bridge deck, the long rope is connected to a root of the bridge tower, projections of connection points of the long rope and the short ropes with the main rope on the bridge deck divide a length of the bridge body from the bridge tower to the main span length direction centerline roughly into three equal parts.

4. The wind-resistant suspension bridge according to claim 1, wherein the suspension bridge comprises a counterweight device that adjusts position of a counterweight block along a bridge length direction and a vertical direction, and the counterweight device comprises a rail, a horizontal drive mechanism, the counterweight block and a counterweight suspension frame, the rail extending along the bridge length direction is fixedly arranged below the bridge body, the horizontal drive mechanism comprises winches, fixed pulleys and traction ropes, which are respectively symmetrically arranged with respect to the main span length direction centerline; a winch is fixed at the bridge tower at one end of the rail below the bridge body on a side facing river bank, and a fixed pulley is fixed at the other end of the rail at a position of the main span length centerline, a traction rope is connected to the winch and surrounds the fixed pulley so as to drive the counterweight suspension frame connected with the traction rope to move along the rail, the counterweight suspension frame is movably suspended on the rail along the bridge length direction; the counterweight block is provided on the counterweight suspension frame so as to be located at a lower portion of the counterweight device; the counterweight suspension frame further comprises a hydraulic device to adjust position of the counterweight block vertically by means of the hydraulic device.

5. The wind-resistant suspension bridge according to claim 1, wherein the suspension bridge further comprises a hanger rod that is provided in a middle section of the bridge body and is fixed integrally with the bridge body, an upper end of the hanger rod extends upwards from the bridge deck over height of the guardrail and is connected to a lower end of the suspension rope, and a lower end of the hanger rod extends downwards from the bridge deck to penetrate the bridge body and is connected to bottom of the bridge body.

6. The wind-resistant suspension bridge according to claim 5, wherein the suspension bridge further comprises a first set of diagonal struts extending upwards obliquely from the bridge deck towards the hanger rod to connect to the hanger rod, and a vertical plane on which the first set of diagonal struts is located extends along the bridge length direction and is located on a side of the hanger rod away from the main span length direction centerline.

7. The wind-resistant suspension bridge according to claim 5, wherein the suspension bridge further comprises a support plate extending outwards horizontally from the bridge deck along the bridge width direction, a second set of diagonal struts and a third set of diagonal struts, the second set of diagonal struts extends upwards obliquely from the support plate toward the hanger rod to connect to the hanger rod; the third set of diagonal struts extends downwards obliquely from the support plate toward the bridge body to connect to the bridge body, and the second set of diagonal struts and the third set of diagonal struts are located outside the guardrail.

8. The wind-resistant suspension bridge according to claim 1, wherein the suspension bridge further comprises an upper slope provided at edge of the bridge deck outside the guardrail along the bridge width direction, and a lower slope provided at bottom edge of the bridge body along the bridge width direction, the upper slope extends downwards obliquely from edge of the bridge deck in the bridge width direction away from the bridge body, and when the upper slope extends to about two-fifths of thickness of the bridge body from top to bottom, the upper slope extends downwards obliquely toward the bridge body to the bottom of the bridge body, such that a harp corner at both ends of the cross section of the bridge body is formed.

* * * * *